United States Patent [19]

Ichikawa

[11] Patent Number: 4,783,176

[45] Date of Patent: Nov. 8, 1988

[54] BEVERAGE CONTAINER

[75] Inventor: Tooru Ichikawa, Misato, Japan

[73] Assignee: Kabushiki Kaisha Hosokawa Yoko, Japan

[21] Appl. No.: 60,460

[22] Filed: Jun. 11, 1987

[30] Foreign Application Priority Data

Aug. 21, 1986 [JP] Japan ..... 61-127416[U]

[51] Int. Cl.[4] ..... B65D 33/16

[52] U.S. Cl. ..... 383/80; 383/100; 206/217

[58] Field of Search ..... 383/100, 80, 30, 29; 206/427, 431, 45.14, 217; 229/7 R, 17 R; 211/71, 74, 49.1

[56] References Cited

U.S. PATENT DOCUMENTS 3,257,036 5/1963 Micallef ..... 383/80
4,669,124 5/1987 Kimura ..... 383/80

FOREIGN PATENT DOCUMENTS 0069807 7/1981 European Pat. Off. .
2016408 3/1979 United Kingdom .
2059383 7/1980 United Kingdom .
2112351 12/1982 United Kingdom .
2159123 10/1984 United Kingdom .

*Primary Examiner*—Willis Little
*Attorney, Agent, or Firm*—Parkhurst, Oliff & Berridge

[57] ABSTRACT

A liquid container generally includes a main container body and a liquid delivery unit secured thereto. The main container body is formed of a flexible sheet and has an opening at its upper end to which the liquid delivery unit is sealingly secured. The liquid delivery unit includes a mouth portion positioned outside the main container body, a joining portion positioned below the mouth portion, a conduit portion extending from the joining portion toward the interior of the main container body, at least two flanges disposed above the joining portion, and at least two ribs positioned between the flanges. The ribs project in a direction perpendicular to front and rear surfaces of the main container body and extend in an axial direction of the conduit. The conduit is formed with a plurality of slots positioned inside the main container body and adjacent the upper opening.

4 Claims, 2 Drawing Sheets

BEVERAGE CONTAINER

CROSS-REFERENCE TO RELATED APPLICATION

This patent application is related to U.S. patent application Ser. No. 826,388 filed on Feb. 5, 1986.

BACKGROUND OF THE INVENTION

The present invention relates to a liquid container for containing therein beverage such as orange juice and sport drink.

Known is a liquid container formed of flexible sheet in the bag shaped configuration provided with an upper opening, such container being available for containing beverage such as for example, orange juice. The beverage is filled in the container through the upper opening and then the opening is thermally sealed. A wall of the container is formed with a hole which is normally closed by an adhesive sheet. For drinking the beverage, the adhesive sheet is peeled from the wall and a sealing film at the hole is broken by the insertion of a straw into an interior of the container.

According to such type of the conventional container, the straw must be further provided. If the straw is not provided together with the container, or if a user loses the straw, it would be difficult to enjoy drinking. For example, the user must try to open the sealed opening of the container which however, is rather troublesome if a cutter or knife is not available.

In order to overcome the above-described disadvantages, another type of liquid container has been developed which includes an upwardly open bag-shaped main body made of a flexible film and a beverage delivery unit secured to the upper opening. The beverage delivery unit is provided with a mouth portion and a conduit extending into an interior of the container body.

The liquid container of the latter type is light in weight and can be easily opened in comparison with other types of liquid containers such as cans and bottles, and therefore, it is used for containing various sauces for noodles, meats and the like as well as beverages.

The liquid container of the improved type can overcome the above described problem. However, since the liquid is filled through the mouth portion of the liquid delivery unit into the container, air in the container may remain at the upper portion thereof, so that the liquid would not be sufficiently filled in the container. Further, when the liquid in the container is poured into another liquid receptacle such as a cup through the delivery unit, part of the liquid in the container still remains therein, since the conduit portion of the delivery unit deeply extends into the container interior. That is, an open end of the conduit is positioned adjacent the container bottom, so that liquid in the container may be displaced toward the upper portion of the container at the inverse posture. The content in the container still remains, which is not economical.

Further, in the improved type of container, two flanges are provided at the mouth portion. During injection of the liquid into a plurality of containers, flanges of the neighbouring container may be disadvantageously entered between the flanges of the first one of the container, to thereby degrade alignment of the containers. Therefore, continuous liquid injection to the successive containers may not be attainable.

SUMMARY OF THE INVENTION

It is therefore, an object of the present invention to overcome the above-mentioned drawbacks and disadvantages and to provide an improved liquid container.

Another object of the invention is to provide a liquid container capable of reducing the amount of air in the container during filling of the liquid and enhancing the liquid filling amount in the container.

Still another object of the invention is to provide a container which can completely discharge liquid therefrom.

Still another object of the invention is to provide a container available for continuous liquid injection into a row of containers.

According to the preent invention, there is provided a liquid container body having an envelope shape, and a beverage or liquid delivery unit secured to an upper opening of the envelope shape container body. The delivery unit provides at least two supporting flanges positioned above the upper opening of the body. Between the flanges, a plurality of ribs are provided each projecting in a direction perpendicular to the front and rear surfaces of the envelope shaped body. The delivery unit also provides a conduit formed with a plurality of slots or openings positioned inside the container body and adjacent the upper opening thereof. These slots allow air in the container to discharge toward the atmosphere during liquid injection into the container, so that complete liquid injection results without substantial accumulation of air in the container.

The ribs extend in an axial direction of the conduit and are provided between the supporting flanges. The ribs can prevent the flanges of the neighbouring liquid container from being engaged with the first one of flanges, so that a plurality of containers can be regularly arranged in a row, and therefore, continuous liquid injection to the respective containers is attainable.

If the delivery unit is used as a straw to discharge the liquid from the container, the slots are closed by the container wall because of the flexibility thereof, so that the liquid can be effectively sucked. Further, when the liquid is poured from the container, the slots in the conduit serve as liquid discharge ports, to thereby completely discharge the liquid from the container.

DETAILED DESCRIPTION OF THE PREFERRED EMBODIMENT

Figure 1:
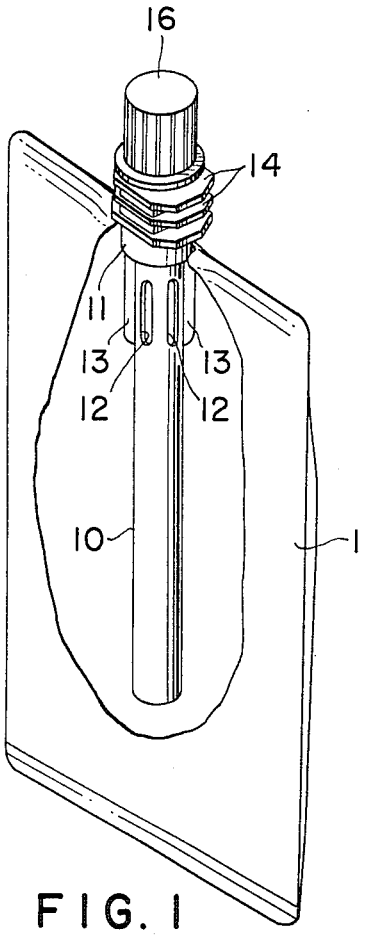
FIG. 1 is a perspective view, with a part broken away, of a liquid container in accordance with the present invention.
Figure 3:
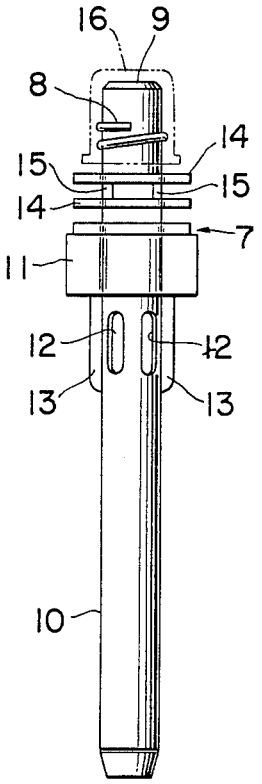
FIG. 3 is a side view of a delivery unit.
Figure 2:
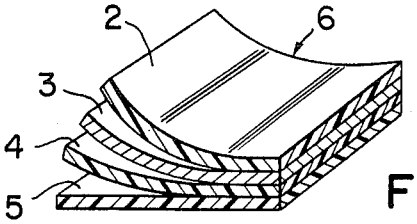
FIG. 2 shows a part of a flexible film used to make a liquid container body shown in FIG. 1.

The present invention will be described with reference to accompanying drawings. Referring first to FIG. 1, a container body 1 has an envelope shaped configuration and is formed with an opening at its top. The container body 1 has a flexible structure and is made of laminated film 6 which includes, as shown in FIG. 2, a polyester film 2 having thickness of 12$\mu$, aluminum foil 3 (9μ), stretched nylon film 4 (15μ), and polyethylene film 5 (60–120μ). A content delivery unit 7 is secured to the upper opening portion of the container body 1. The content delivery unit 7 is integrally coupled to the container body 1 upon sealing the upper opening portion.

The content delivery unit 7 includes a mouth portion 9 having a thread portion 8 and a conduit portion 10 provided integral with the mouth portion 9. The mouth portion 9 is positioned outside the container body 1 when the content delivery unit 7 is fixedly secured to the open end of the container body 1. The conduit portion 10 has an upper end portion provided with a joining portion 11 for joining the conduit to the mouth portion 9. At the conduit 10 and adjacent the joining portion 11 and inside the body, provided are a plurality of slots 12 and a pair of ribs 13 extending in axial direction of the conduit portion 10. The slots 12 are formed symmetrically relative to each other. The conduit portion 10 has a longitudinal length whose lower end is positioned in the vicinity of a bottom of the container body 1 when the content delivery unit 7 is fixedly secured to the open end of the container body 1.

Two supporting flanges 14, 14 extend in the transverse direction of the conduit 10 and are positioned between the thread portion 8 of the mouth 9 and the joining portion 11. The flanges are spaced away from each other in the axial direction of the conduit 10, and each a generally octogonal shape. The container body has a three dimensional shape upon injection of the beverage, and two sides of the octogonal flange are directed in parallel with the front and rear surfaces of the container, while two sides of the remaining six sides are directed in a direction perpendicular to the front and rear surfaces of the container body 1.

Figure 4:
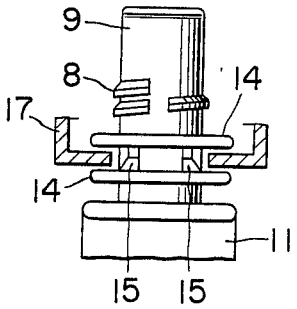
FIG. 4 is a front view of a part of the delivery unit.
Figure 5:
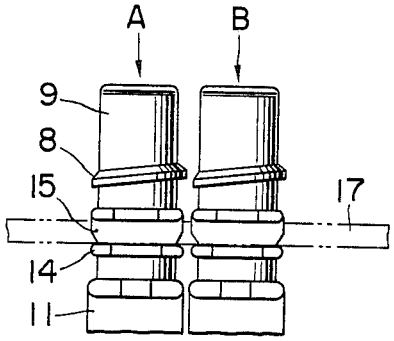
FIG. 5 is a side view of parts of the delivery units each moving along a guide member; and, FIG. 6 is a top view of a liquid container.
Figure 6:
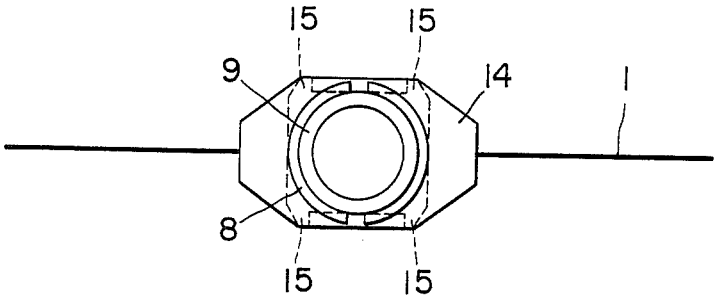

Ribs 15,15 project from an outer peripheral surface of the mouth portion 9 in a direction perpendicular to the front and rear surfaces of the container body 1 and extend in the axial direction of the conduit 10. These ribs are positioned between the upper and lower flanges 14 and 14. As best shown in FIGS. 4 and 5, the ribs 15 extend to the free ends of the flanges 14 and lower end portions of the ribs 15 are cut away as shown in FIG. 5. These ribs 15 are provided in order to prevent the flanges 14 of a resultant liquid container A from engaging the flanges 14 of a neighbouring liquid container B when these containers are moved along a guide member 17. A cap 16 is provided as shown in FIG. 1, which cap is threadingly engaged with the thread 8 of the mouth portion 9.

Next, an operation mode of this invention will be described.

When the content delivery unit 7 is used as a straw or sipper, the cap 16 is removed from the mouth portion 9 for holding the mouth portion 9 in a human mouth. Upon sucking or sipping, the wall of the container body 1 is urged toward the slots 12 formed at the conduit portion 10 because of the flexibility of the container body, so that the slots 12 are closed by the wall. As a result, a beverage is sucked from the lower end of the conduit portion 10.

When the content delivery unit 7 is used as a pouring means, the user holds the main body 1 with a hand and inclines the same, so that the beverage can be discharged through the slots 12 of the conduit 10 out of an opening of the mouth 9. Since the slots 12 are positioned at the upper portion of the conduit 10, the beverage is completely discharged out of the container body 1 at the inverse posture of the container.

For filling the container body with the beverage, the container bodies 1 are suspended by the guide member 17 of a beverage filling apparatus (not shown) through the supporting flanges 14. In this case, the ribs 15 formed between the flanges 14 prevents the flanges from being engaged with the flanges of the neighbouring liquid container, so that the container bodies can be aligned in a row without disturbance during beverage injection thereinto. Further, the plurality of slots 12 allow air in the container to discharge toward atmosphere therethrough during beverage injection, and therefore, sufficient amount of the beverage can be filled in the container.

The ribs 15 also prevent the delivery unit 7 from thermal contraction during its cooling at the process of injection molding of the delivery unit, to thus improve dimensional stability. Furthermore, the ribs 12 are provided for reinforcing the portion at which the slots 12 are formed.

As described above, according to the present invention, beverage can be effectively filled into the container body by smooth discharge of air through the slots, and engagement between neighbouring container bodies is obviated to thus provide regular alignment in a row during injection of the beverage. Further, beverage can be effectively discharged out of the container body.

What is claimed is:

1. A liquid container comprising:

(a) an envelope shaped main container body formed of a flexible sheet and having an opening at its upper end, said main body having front and rear surfaces; and, (b) a liquid delivery unit secured to said opening upon sealing thereof for allowing said liquid to pass therethrough, said delivery unit comprising:

(1) a mouth portion positioned outside said main container body, (2) a joining portion positioned below said mouth portion, (3) a conduit portion extending from said joining portion toward inside said main container body, (4) at least two flanges disposed above said joining portion, and, (5) at least two ribs positioned between said flanges and projecting in a direction perpendicular to said front and rear surfaces, said conduit being formed with a plurality of slots positioned inside said main container body and adjacent said upper opening.

2. A liquid container as claimed in claim 1, further comprising a thread formed on said mouth portion and a cap member threadingly engaged with said thread.

3. A liquid container as claimed in claim 1, further comprising a pair of ribs each extending adjacent said slots in an axial direction of said conduit portion and inside said main body.

4. A liquid container as claimed in claim 1, wherein said flexible sheet comprises laminated films.

* * * * *